US009809371B2

(12) United States Patent
Veternik et al.

(10) Patent No.: US 9,809,371 B2
(45) Date of Patent: Nov. 7, 2017

(54) EASY TEAR PACKAGE

(71) Applicant: INTERCONTINENTAL GREAT BRANDS LLC, East Hanover, NJ (US)

(72) Inventors: Paul Veternik, Munich (DE); Marcela Maia Lopez, Curitiba (BR); Anderson Silva, Curitiba (BR)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

(21) Appl. No.: 14/769,926

(22) PCT Filed: Mar. 10, 2014

(86) PCT No.: PCT/US2014/022397
§ 371 (c)(1),
(2) Date: Aug. 24, 2015

(87) PCT Pub. No.: WO2014/164424
PCT Pub. Date: Oct. 9, 2014

(65) Prior Publication Data

US 2016/0001950 A1 Jan. 7, 2016

Related U.S. Application Data

(60) Provisional application No. 61/776,963, filed on Mar. 12, 2013.

(51) Int. Cl.

| | |
|---|---|
| ***B65D 75/00*** | (2006.01) |
| ***B65D 75/58*** | (2006.01) |
| ***B65D 65/10*** | (2006.01) |
| ***B65D 75/08*** | (2006.01) |

(Continued)

(52) U.S. Cl.
CPC ..... *B65D 75/5888* (2013.01); *B65D 65/10* (2013.01); *B65D 75/08* (2013.01);
(Continued)

(58) Field of Classification Search
CPC ..... B65D 75/5888; B65D 5/5445; B65D 75/585; B65D 65/10; B65D 85/60;
(Continued)

(56) References Cited

U.S. PATENT DOCUMENTS

| | | | | |
|---|---|---|---|---|
| 2,324,017 A | | 7/1943 | Neumair | |
| 3,967,773 A | * | 7/1976 | Kaufmann | B65D 5/001 229/101.1 |

(Continued)

FOREIGN PATENT DOCUMENTS

| | | |
|---|---|---|
| DE | 20 2011 002787 U1 | 5/2011 |
| GB | 2 441 320 A | 3/2008 |
| JP | 09-104449 | 4/1997 |
| JP | 2003-321058 | 11/2003 |
| JP | 2012-162270 | 8/2012 |
| WO | 91/06488 A1 | 5/1991 |

*Primary Examiner* — Peter Helvey
(74) *Attorney, Agent, or Firm* — Hoffmann & Baron, LLP

(57) ABSTRACT

A consumable product package assembly includes at least one consumable product and a package for enclosing the at least one product. The package includes an elongate body portion surrounding the product and a longitudinal seal extending at least partially along the length of the body portion. The seal has a pair of longitudinally spaced notches extending transversely to the distal edge of the seal. The notches define a grasping tab therebetween to initiate tearing of the body portion of the package transversely about the product. The body portion further includes at least one score location extending between the notches to weaken the package thereat to facilitate controlled tearing of the body portion.

14 Claims, 4 Drawing Sheets

(51) Int. Cl.
*B65D 75/26* (2006.01)
*B65D 85/60* (2006.01)

(52) U.S. Cl.
CPC ..... *B65D 75/26* (2013.01); *B65D 75/5827* (2013.01); *B65D 75/5833* (2013.01); *B65D 75/5844* (2013.01); *B65D 85/60* (2013.01)

(58) Field of Classification Search
CPC .... B65D 75/08; B65D 75/26; B65D 75/5827; B65D 75/5833; B65D 75/5844; Y10S 206/82; Y10T 24/1402
USPC ..... 229/87.01, 87.05, 87.08
See application file for complete search history.

(56) References Cited

U.S. PATENT DOCUMENTS

| | | | | |
|---|---|---|---|---|
| 5,409,115 | A * | 4/1995 | Barkhorn | B65D 75/5833 206/440 |
| 5,470,016 | A * | 11/1995 | Ljungstrom | B65D 5/0005 229/101.1 |
| 5,704,539 | A * | 1/1998 | Ljungstrom | B65D 5/0005 229/101.1 |
| 6,799,715 | B1 * | 10/2004 | Bennett | B65D 75/5888 229/101.1 |
| 2004/0252920 | A1 | 12/2004 | Moteki et al. | |
| 2006/0151587 | A1 * | 7/2006 | Garbarino | B65D 27/00 229/314 |
| 2008/0118611 | A1 * | 5/2008 | Cellie | B65D 5/662 426/108 |
| 2011/0297681 | A1 * | 12/2011 | Bowers | B65D 75/585 220/266 |

* cited by examiner

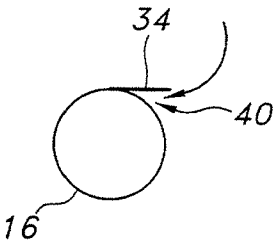
FIG. 6A
FIG. 6B
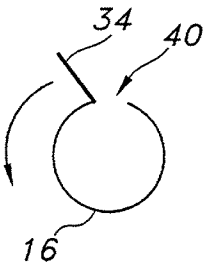
FIG. 6C
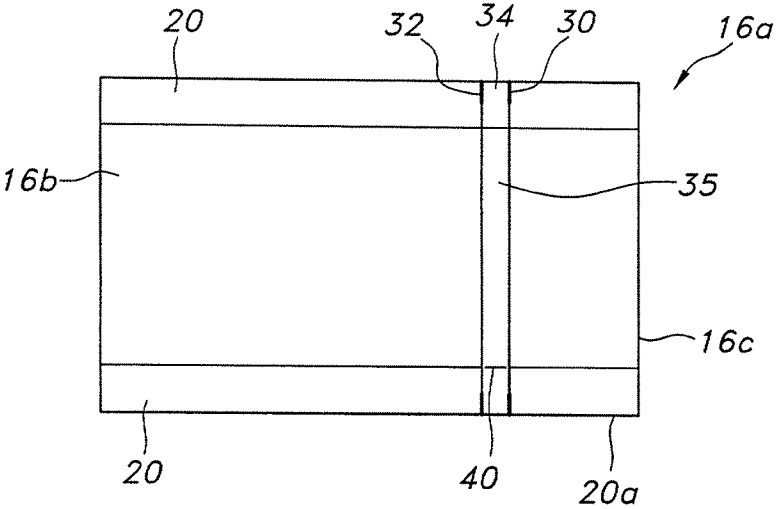
FIG. 5

EASY TEAR PACKAGE

CROSS REFERENCE TO RELATED APPLICATIONS

This application is the National Stage of International Application No. PCT/US2014/022397, which designates the U.S., filed 10 Mar. 2014, which claims the benefit of U.S. Provisional Patent Application No. 61/776,963 filed Mar. 12, 2013, the contents of all of which are incorporated herein by reference in its entirety.

FIELD OF THE INVENTION

The present invention relates generally to a package assembly which supports product pieces. More particularly, the present invention relates to a sheet package using a tear strip to open the package.

BACKGROUND OF THE INVENTION

It is common to package and distribute various product pieces in a wide variety of sheet formed packages. In the confectionery industry, for example, candy pieces are often contained in a sheet formed bag or package or may be arranged in a longitudinal stacked array which is covered or wrapped in an outer wrapping forming an elongate stick-like package. The sheet used to form the package is typically formed of film-like material. The sheet container is often openable by a tear strip.

For example, in a stick-like package, a fin seal is used to close the sheet. It has been known to place spaced apart transverse notches in the fin seal which form a tab therebetween for manual grasping and pulling in a manner where a tear is initiated transversely about the longitudinal package. This forms the tear strip about the package which opens the package permitting dispensing of the candy products contained therein.

While an arrangement such as this serves adequately for its intended purposes, it has been found that with certain materials it is difficult to initiate the tear using the tab between the notches in an acceptable manner. The tensile strength of the sheet may prevent the tear from being properly initiated or after the tear is initiated, it may be difficult to provide a clean tear about the package. Moreover, in certain instances, pulling on the tab may cause the package to tear in the undesirable opposite direction.

SUMMARY OF THE INVENTION

The present invention provides a consumable product package assembly comprising at least one consumable product. The package is provided for enclosing the product. The package includes an elongate body portion surrounding the product and a longitudinal seal extending at least partially along the length of the body portion. The seal has a pair of longitudinally spaced notches extending transversely to the distal edge of the seal. The notches define a grasping tab therebetween to initiate tearing of the body portion of the package transversely about the product. The body portion further includes at least one score location extending between the notches to weaken the package thereat to facilitate controlled tearing of the body portion.

In a preferred embodiment of the present invention, the package encloses a plurality of longitudinally stacked confectionery products and is formed of a sheet where the sheet has an inner surface surrounding the products, longitudinal edges of the sheet being joined adjacent the inner surface for forming a fin seal. In addition, preferably, the body portion includes three transversely spaced parallel score lines.

Additionally, a tear strip is provided for a sheet formed package where the tear strips surround the package. The tear strips have spaced apart notches defining a grasping tab therebetween for initiating opening of the package. At least one score line between the notches is provided for weakening the package thereat to facilitate controlled tearing of the package.

BRIEF DESCRIPTION OF THE DRAWINGS

FIG. 5 is a plan view of the sheet used to form the package assembly of the present invention.

FIGS. 6A-6C show, schematically, the opening of the package assembly of the present invention.

DETAILED DESCRIPTION OF THE PREFERRED EMBODIMENTS

The present invention provides a flexible packaging comprising a flap at any sealing seam, e.g., formed by two parallel notches perpendicular to the edge of the sealing seam. The so formed flap can be used to open a package like a tear tape forming a strip. Preferably, the strip can be further formed along two opposed weakening lines extending into the packaging. The invention contemplates the use of a weakening area at one side of the sealing layers in the area where both layers direct in diverging paths, to easy break this side of the formed flap to enable the continuous tear opening of the package.

The present invention will be described primarily with respect to a package for a consumable product or products, more particularly confectionery products. One such package has a plurality of products arranged in a longitudinal stacked array. The package is formed from a sheet wrapped around the product(s) and provides a device for permitting easy opening of the package, especially where the package is formed of a high tensile strength material. It is understood that the concept of the present invention may be achieved in other packaging configurations, such as, for example, bags.

Figure 2:
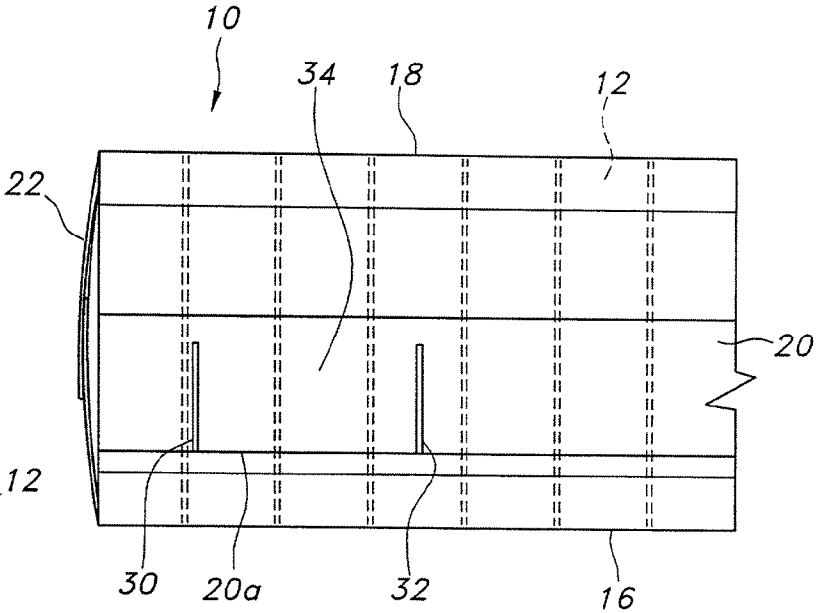
FIG. 2 is a partial plan view of the package assembly of FIG. 1 showing notches in a fin seal forming a tab.
Figure 1:
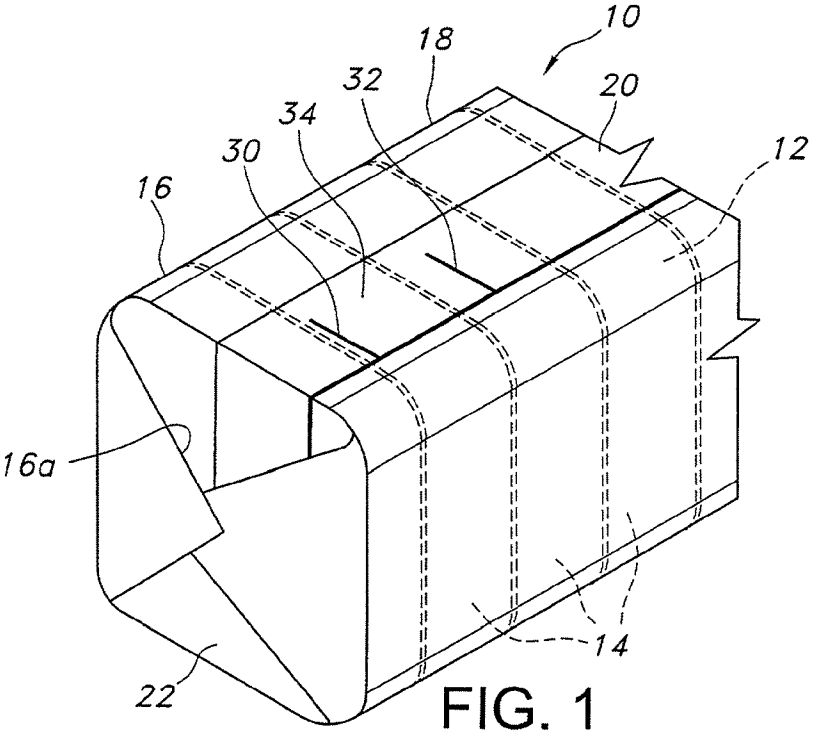
FIG. 1 is a partial perspective showing of the package assembly of the present invention.

Referring now to FIGS. 1 and 2, a package assembly 10 of the present invention includes a plurality of confectionery products 12 arranged in a longitudinally stacked array 14. The confectionery products 12 may include items such as gum, candy, lozenges and the like. The products 12 may be individually wrapped.

Referring additionally to FIG. 5, the package assembly 10 includes a package 16 formed from a sheet 16*a* which is wrapped about the array 14. While the sheet 16*a* may be formed of various single or multilayer materials, including laminates, foils and films, the present invention finds particular utility with the use of material having high tensile strength which would ordinarily resist tearing.

The sheet 16*a* is wrapped about the array 14 of products 12 in a generally conventional manner to form a body portion 18 about the products 12. The sheet 16*a* also forms an extending fin seal 20 which extends generally along the length of the package 16. Package 16 is formed by placing an inside surface of the sheet 16*a* against the array 14 and wrapping the inside surface about the array forming the body portion 18. The fin seal 20 is formed by bringing longitudinal edges of the sheet together and adhesively securing those edges to each other. In use, the fin seal 20 may be folded down against the body portion 18 to provide a low profile. The opposite longitudinal ends 22 of the array 14 may be closed in conventional manner, such as by use of a fin seal or folded ends as shown in FIGS. 1 and 2.

In order to permit opening of the package 16, the fin seal 20 is provided with a pair of longitudinally spaced transversely extending notches 30 and 32. The notches 30 and 32 extend to the distal marginal edge 20*a* of fin seal 20 and define therebetween a tab 34 for manual grasping by the consumer. In the present invention, the notches 30 and 32 are spaced apart a given distance to provide a wide tab 34. The wide tab 34 defines a wider tear strip 35, which is easier to grasp, but requires a high opening force to break at the fin seal area.

Figure 4:
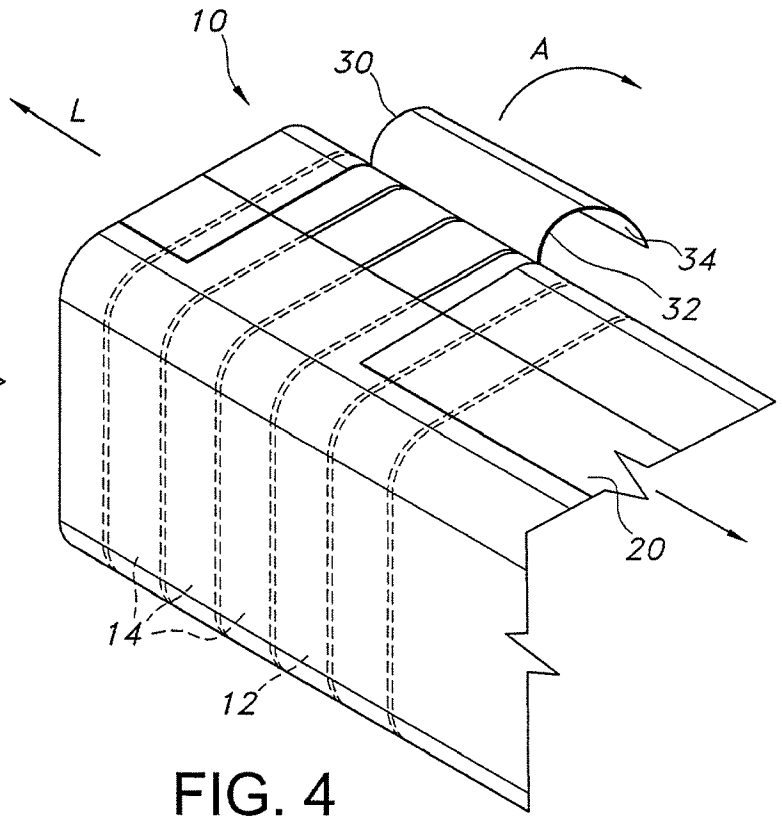
FIG. 4 shows the lifting of the tab to initiate the tear.
Figure 3:
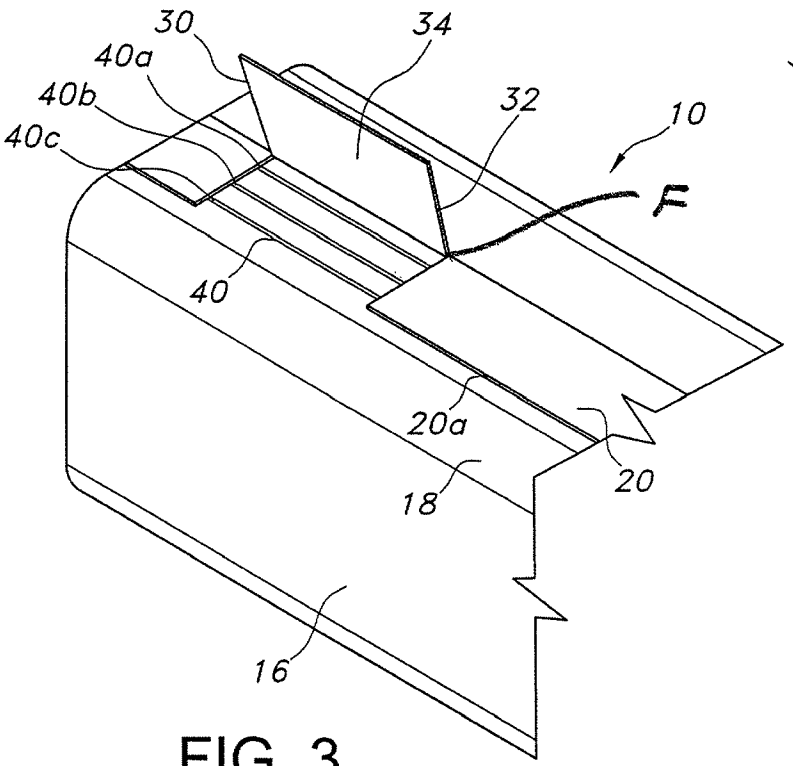
FIG. 3 is a detailed showing of the package assembly of FIG. 1 with the fin seal raised.

Referring additionally to FIGS. 3 and 4, in opening of package 16, the tab 34 may be lifted from the plane of the fin seal 20 by virtue of the notches 30 and 32. The tab may be pulled around the array 14 of products 12 in a direction of arrow A shown in FIG. 4. This initiates a tear along the direction of notches 30 and 32 and begins to tear open the package 16 circumferentially about the array 14 transverse to the longitudinal direction L of the package 16.

It has been found however that with certain materials, especially materials having a high degree of tensile strength or tear resistance, it is difficult to cleanly break the tab 34 from the body portion 18 to initiate the tear. Quite often by attempting to do so the sheet forming the package 16 may rip in an undesirable manner. Moreover, lifting of the tab may cause the tear to initiate in an undesirable direction opposite arrow A.

In order to assist in forming a proper tear opening, the present invention provides one or more score locations in package 16 adjacent tab 34. Referring again to FIGS. 3 and 5 and additionally to FIGS. 6A-6C, the present invention provides weakening locations in the form of score lines 40 which in the present illustrative embodiment include three individual score lines 40*a*, 40*b* and 40*c* arranged longitudinally along the package beneath fin seal 20 in a transversely spaced apart generally parallel arrangement. The score line may extend fully between the notches 30 and 32, or may be placed intermediately between the notches 30 and 32. Such different arrangements help compensate for any tolerances during manufacturing.

Figure 7:
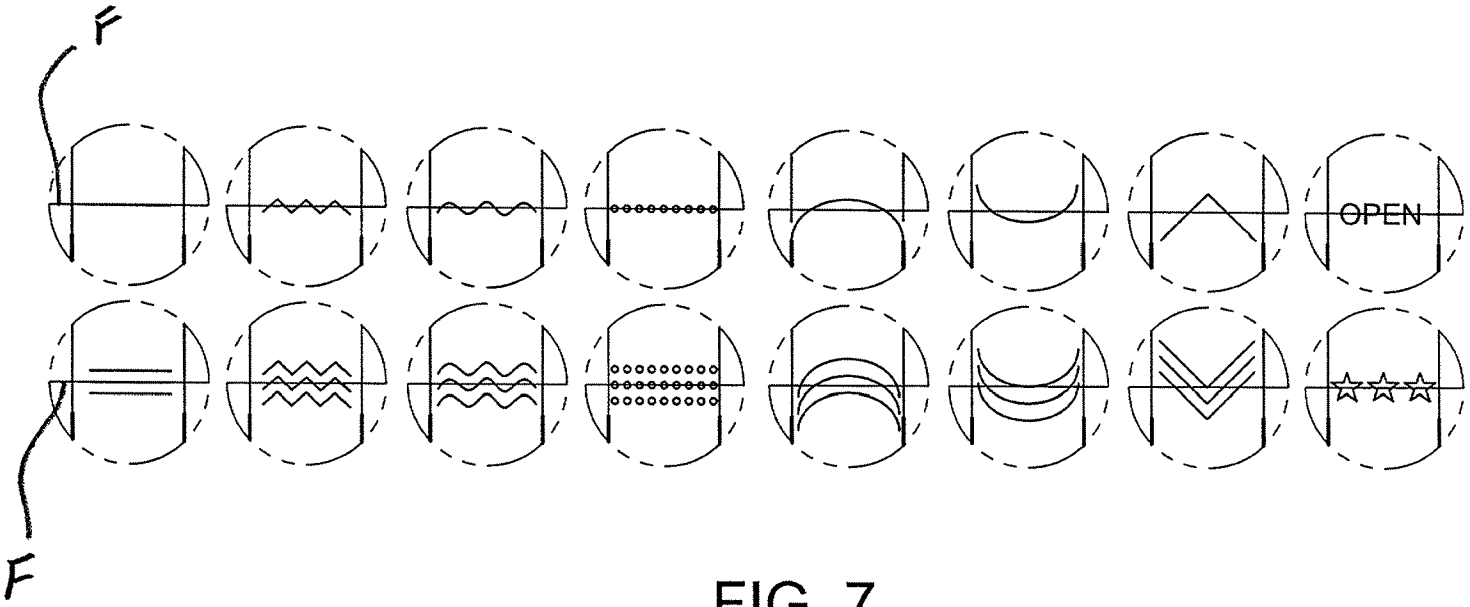
FIG. 7 shows various score line patterns.

Ideally, as shown in FIG. 7, one score line may be placed at the location of folding of the fin seal, fold line F. Due to tolerances in manufacturing, it is not always possible to place the score line at the exact fold location. Therefore, multiple score lines are used to assure that score lines promote proper tear propagation. Referring again to FIG. 3, one preferred location for the fold line F would be along score line 40*b*.

While three score lines are shown, other numbers of score lines may be employed. Score lines 40 may be formed in any well-known manner, including laser cuts or perforations. The shape and configuration of the score lines can vary such as, for example, lines, grids, dots, dot arrays, alpha-numeric text, drawings, icons or any other patterns. Examples of such shapes are also shown in FIG. 7. The score locations extend only partially through the sheet so as to maintain environmental integrity of the package 16. The score lines may be applied either on the inside 16*b* or the outside 16*c* of the sheet. While the score lines extend between the notches 30 and 32, the score lines could extend the length of the package to assist in folding the fin seal.

Score lines 40 are positioned adjacent the base of tab 34 opposite the distal edge 20*a* of fin seal 20. The purpose of the score lines is to establish a weakening area or pattern to reduce the opening force required to break the tear strip 35 and to permit the easy tearing of the tab from the body portion 18 of package 16 so as to more easily initiate the tear about the package. In addition, the score lines prevent the tear from propagating in an undesirable opposite direction. In that regard, the use of plural score lines helps assure that the tab will be lifted for tearing in the direction of arrow A as opposed to begin tearing in the opposite direction. It is contemplated that if the tear initiates in the opposite direction, such tear will be terminated once the tear reaches one or more of the score lines 40.

While the present invention has been described above particularly for use with a package including a single product or a plurality of product pieces arranged in a longitudinally stacked array, the concept of the present invention may also be employed in an openable bag type container where tear strips as above described may be used to facilitate tearing open the open upper end of the bag.

In such arrangements, the concept of the present invention may be employed on seals other than fin seals, such as, for example, corner seals for bags.

Various changes to the foregoing described and shown structures would now be evident to those skilled in the art. Accordingly, the particularly disclosed scope of the invention is set forth in the following claims.

What is claimed:

1. A consumable product package assembly comprising:

at least one consumable product;

a package for enclosing said product, said package including an elongate body portion surrounding said product and a longitudinal seal extending at least partially along the length of said body portion;

said seal having a pair of longitudinally spaced notches extending transversely from the distal edge of said seal to a fold line of the seal, said notches defining a grasping tab therebetween to initiate tearing of said body portion of said package transversely about said product;

said body portion further including at least one score location extending partially through the body portion and extending between said notches spaced from said fold line in a direction away from said seal to weaken the package thereat to facilitate controlled tearing of body portion.

2. A package assembly of claim 1 wherein said seal is a fin seal.

3. A package assembly of claim 2 wherein said package is formed of a sheet, said sheet having an inner surface for surrounding said product, longitudinal edges of said sheet being joined adjacent said inner surface for forming said fin seal.

4. A package assembly of claim 3 wherein said fin seal is folded down against said body portion.

5. A package assembly of claim 3 wherein ends of said sheet are folded to enclose opposite ends of said at least one consumable product.

6. A package assembly of claim 3 wherein said sheet is a film.

7. A package assembly of claim 2 wherein said body portion includes a plurality of said score locations.

8. A package assembly of claim 7 wherein said body portion includes three transversely spaced parallel said score locations.

9. A package assembly of claim 2 wherein said product includes a plurality of longitudinally stacked products.

10. A package assembly of claim 2 wherein said at least one score location includes a score line.

11. A package assembly of claim 10 wherein said score lines include configurations selected from the group consisting of lines, grids, dots, alpha-numeric text, drawing, icons and combinations thereof.

12. A package assembly of claim 1 wherein said consumable products are confectionery products.

13. A package assembly of claim 7 wherein said fin seal is folded at a fold line and wherein said fold line aligns with one of said score locations.

14. A package assembly of claim 8 wherein said fin seal is folded at a fold line and said fold line aligns with the middle one of said three transversely spaced scored locations.

* * * * *